US006286148B1

(12) United States Patent
Meyer

(10) Patent No.: US 6,286,148 B1
(45) Date of Patent: Sep. 11, 2001

(54) GLOVE

(75) Inventor: Greg Meyer, Louisville, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/729,344

(22) Filed: Dec. 5, 2000

(51) Int. Cl.[7] ..... A41D 19/00
(52) U.S. Cl. ..... 2/161.1
(58) Field of Search ..... 2/159, 161.1, 161.4

(56) References Cited

U.S. PATENT DOCUMENTS 3,372,401 * 3/1968 Woodward .
3,490,074 * 1/1970 Hardy .
3,918,097 * 11/1975 Mlodoch .
4,730,354 * 3/1988 Saito .
5,195,188 3/1993 Bourdeau et al. ..... 2/161 A
5,197,149 3/1993 Overton ..... 2/161 A
5,513,391 * 5/1996 Garneau et al. .
5,740,555 4/1998 Renegar ..... 2/161.2

* cited by examiner

*Primary Examiner*—Rodney M. Lindsey
(74) *Attorney, Agent, or Firm*—Greenblum & Bernstein P.L.C.

(57) ABSTRACT

A glove especially adapted to the practice of a sport having its own tightening arrangement, such that it cannot be lost, the tightening arrangement including a single strap starting from a lower fixed point of the glove located in an area of the wrist and extending freely around the glove toward an upper fixed point located substantially perpendicular to the lower point by describing a spiral, the upper fixed point constituting a traction hold relative to which the strap can be biased to tighten the glove around the user's hand, along a path that corresponds substantially to one turn but does not close on itself.

11 Claims, 3 Drawing Sheets

GLOVE

BACKGROUND OF THE INVENTION

1. Field of the Invention

The present invention relates to a glove especially adapted to the practice of particularly active sports, such as skiing, ice hockey, roller skating, etc., which involve the risk of dropping, or eves losing the glove while practicing the sport, or which require proper adaptation to the hand morphology to enable a good transmission of sensations, and adequate tightening with no risk of losing a sports article such as a ski pole, the shaft of a hockey stick, etc.

2. Description of Background and Relevant Information

To overcome the aforementioned disadvantages, it is known to provide the glove with its own tightening means such that it cannot be lost, and/or to improve its adaptation to the morphology of the hand.

Thus, strap systems are known which surround the base of the glove in the area of the user's wrist and tighten it thereon.

This presents the major drawback of blocking blood circulation, which, of course, is never recommended.

To overcome this drawback, strap tightening systems have also been proposed, which act between two fixed points, arranged on the back or side of the palm of the glove so as to act partially on the latter in a demarcated zone.

It has been shown that, although this provides a first solution to the aforementioned drawbacks, there results however a completely random, unreliable tightening, because the strap does not completely surround the hand along its entire periphery. In addition, the adaptation to the hand morphology is not optimized.

SUMMARY OF THE INVENTION

An object of the present invention is to overcome the aforementioned various drawbacks of the systems for tightening the gloves adapted especially to the practice of a sport and, to this end, relates to a sports glove having its own tightening arrangement, wherein the tightening arrangement includes a strap extending from a lower fixed point of the glove, located in the area of the wrist, freely around the glove and toward an upper fixed point located substantially perpendicular to the lower point, by describing a spiral, the upper fixed point constituting a traction hold relative to which the strap can be biased to tighten the glove around the user's hand, along a path that corresponds to one turn but does not close on itself.

The present invention also relates to the characteristics which will become apparent from the description that follows, and which must be considered separate or according to all of their possible technical combinations.

BRIEF DESCRIPTION OF THE DRAWINGS

This description, provided by way of a non-limiting example, will help to better understand how the invention can be embodied, with reference to the annexed drawings, in which.

DETAILED DESCRIPTION OF THE INVENTION

Figure 1A:
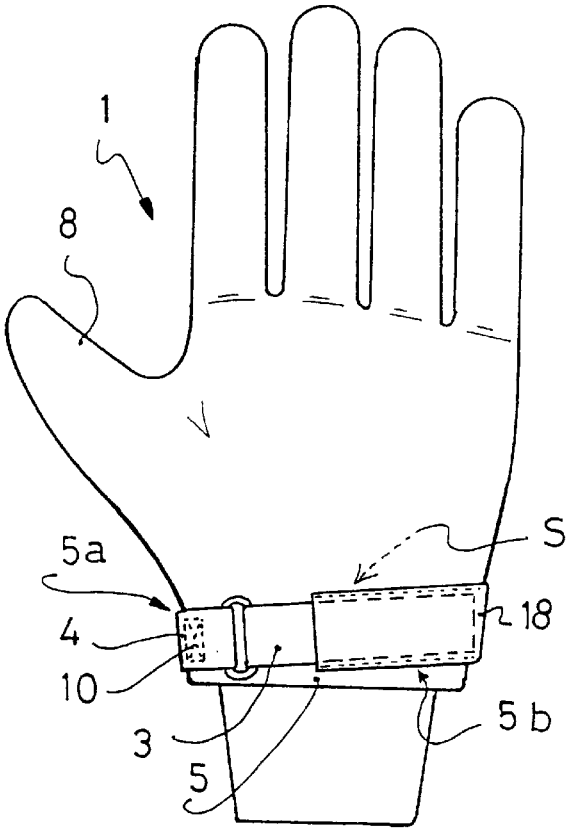
FIGS. 1A and 1B show a glove according to a first example of embodiment, seen from the palm side and from the back side, respectively.
Figure 1B:
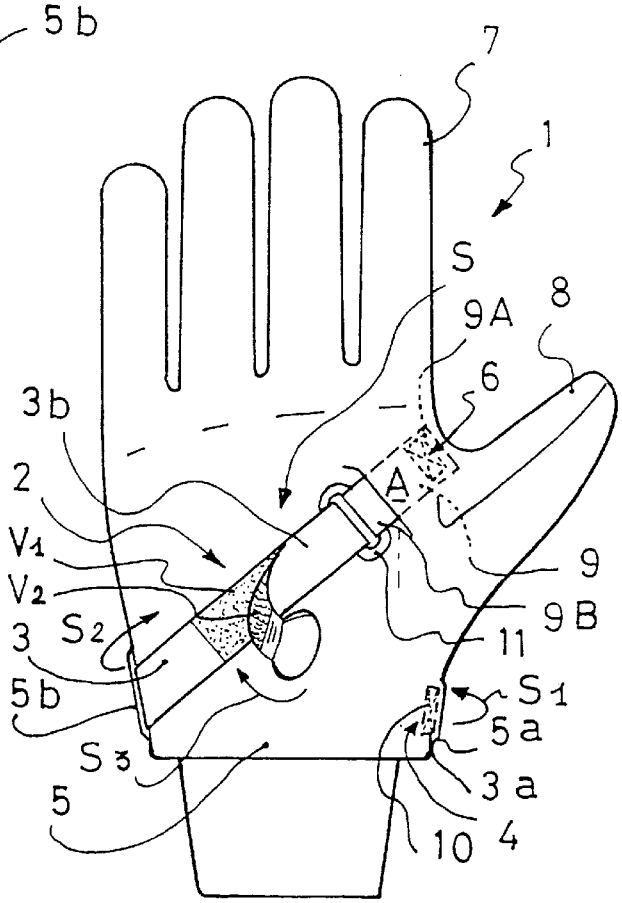

According to a first example of the invention, as shown in FIGS. 1A and 1B, the glove 1 covers the hand of the user and includes its own tightening arrangement 2 such that it cannot be lost, and to enable it to adapt properly to the morphology of the hand.

This tightening arrangement is constituted by a single strap 3 starting from a lower fixed point 4 of the glove 1, in the area of the wrist 5, and extending freely around the glove 1 toward an upper fixed point 6 located substantially perpendicular to the lower point 4, by describing a spiral S.

The upper fixed point 6 constitutes a traction hold relative to which the strap 3 can be biased to tighten the glove 1 around the user's hand, along a path that corresponds substantially to one turn but does not close on itself.

In fact, the spiral 3 described by the tightening strap 3 makes a complete turn, or quasi-complete turn, around the glove 1.

As shown clearly in FIGS. 1A and 1B, the lower point 4 is located in a lateral zone 5*a* of the wrist 5, and more specifically beneath the thumb 8, goes around the wrist on its inner surface 5*b*, i.e., on the side of the palm of the glove 1, and extends toward the upper fixed point 6 located on the back of the glove, along a spiral S making a complete turn.

As shown in FIG. 1B, the upper point 6, located on the back of the glove 1, is positioned substantially in an intersection or junction zone A of the forefinger 7 and the thumb 8.

The lower fixed point 4 is constituted by a seam 10 affixing an end 3*a* of the strap 3 to the glove 1, in the lateral zone 5*a* of the wrist 5 beneath the thumb 8.

The upper fixed point 6 is constituted by the strap 9 fixed at one end by a seam 9A on the glove 1, in the area of the intersection zone A, and provided at its other end 9B with a buckle 11 in which the other free end 3*b* of the strap 3 is introduced before being folded back so as to be immobilized in position, according to the desired tension, via an appropriate fixing arrangement.

In the illustrated embodiment, this fixing arrangement comprises self-gripping elements V1, V2, such as hook-and-loop fasteners like Velcro, e.g., that are complementarily arranged on two surfaces of the end 3*b* of the strap 3, facing one another once they have been folded back.

Still according to the present example of the invention, the strap 3 is guided at least partially in the inner zone 5*b* of the wrist 5 by an external sheath 18, made by doubling the constituent material of the glove 1, in which the strap 3 slides freely. According to another embodiment (see FIG. 3), the strap 9 is also guided internally between two external and internal layers of the glove. The sheath 18 can be extended along the major portion of the path of the strap 3 as shown, for example, in FIGS. 2A and 2B.

According to the preceding description, the strap 3, which starts from the lower fixed point 4 (FIG. B), extends in the direction S1 on the side of the palm, then turns on the lateral side 5*b* of the wrist 5 in the ascending direction S2, is engaged in the buckle 11 and folded back in the direction S3. The strap 3, as well as the strap 9, can also be partially or completely elastic so as to improve the tightening effect.

Figure 2A:
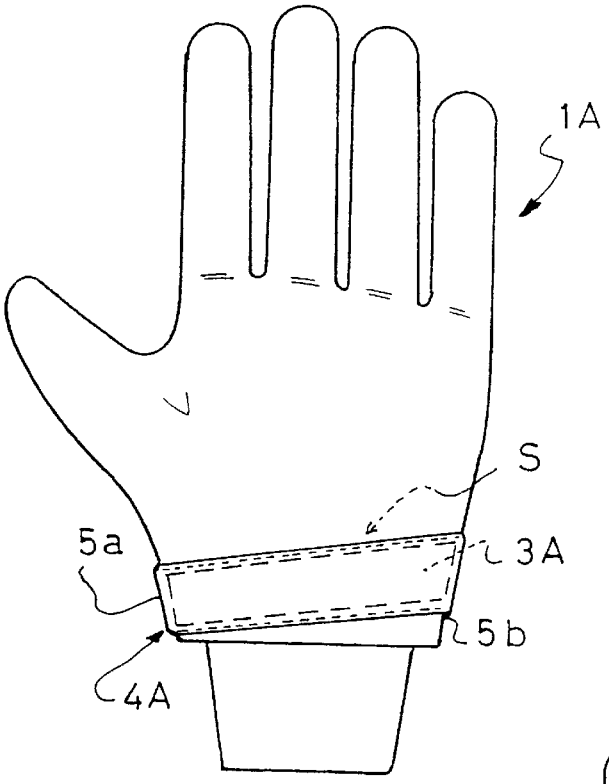
FIGS. 2A and 2B show a glove according to a second embodiment, seen from the palm side and from the back side, respectively.
Figure 2B:
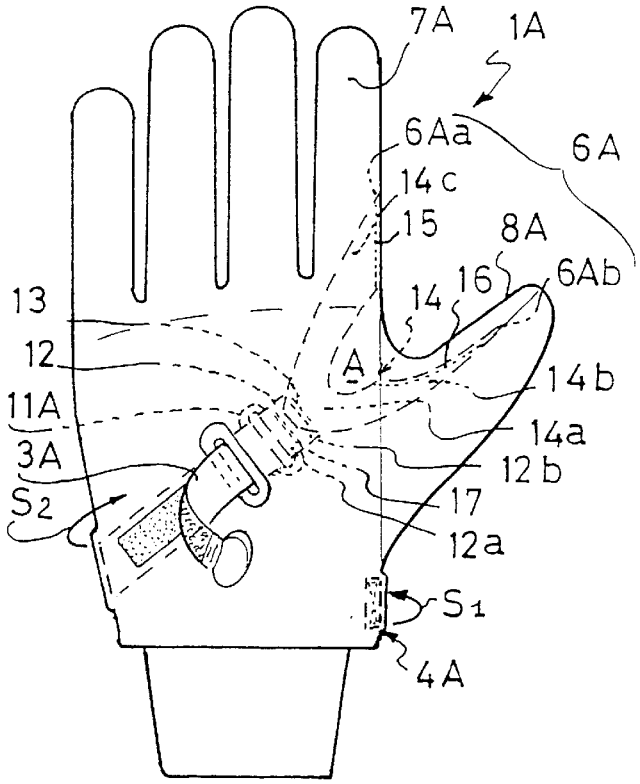
Figure 3:
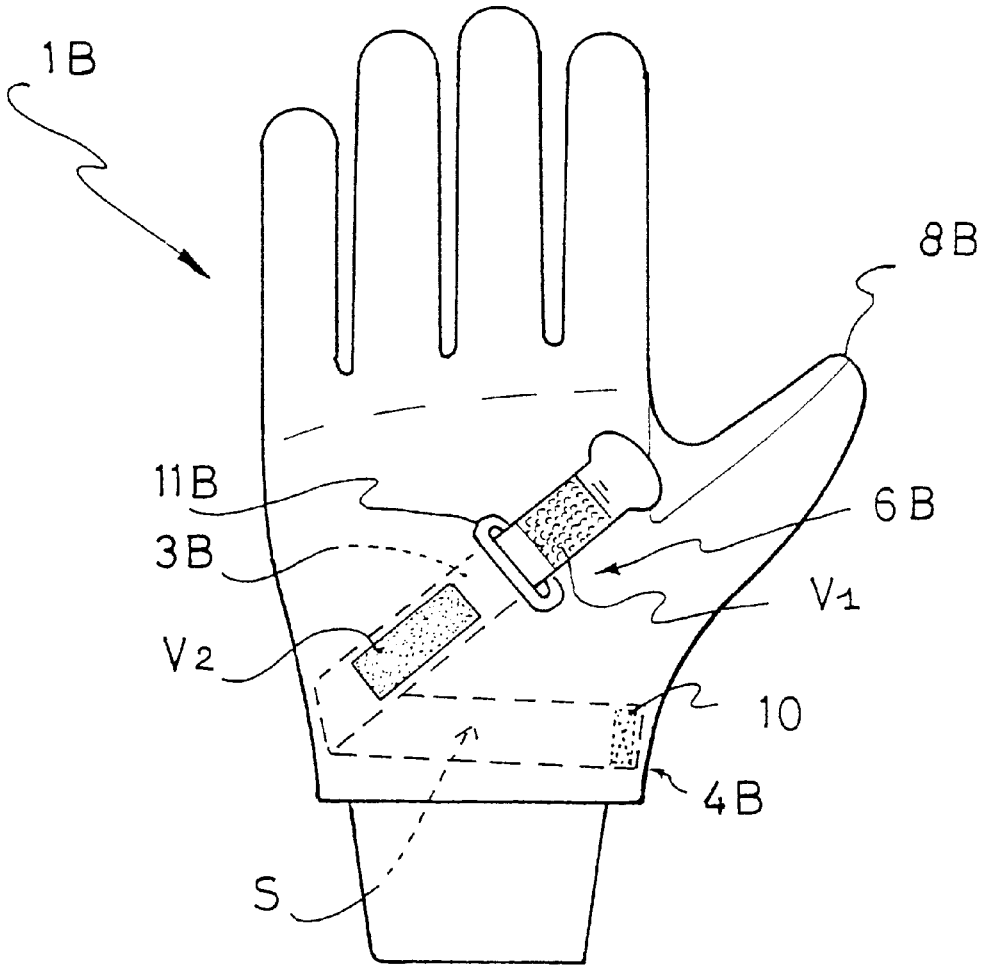
FIG. 3 shows a view similar to FIGS. 2A, 2B of a third embodiment.

The example of the invention shown in FIGS. 2A, 2B, and 3 differs essentially from the preceding ones in that the tightening of the glove 1A on the user's hand is done by a non-elastic strap 3A connecting the lower fixed point 4A to the upper fixed point that is doubled via the buckle 11A constituting the traction hold, which is itself affixed to the end 12*a* of a free elastic element 12, the other end 12*b* of which is connected by a seam 13 to an equally free end 14*a* of a fork-shaped flexible piece 14. Each of the arms 14*b*, 14*c* of the latter is connected to the glove 1A by seams 15 and 16, in the zone of the forefinger 7A and in the zone of the thumb 8A, respectively, constituting a double upper fixed point 6A*a*, 6A*b*.

It must also be specified that the free elastic 12 is affixed to the buckle 11A by being folded back after extending through the buckle 11A and immobilized by a seam 17.

This construction makes it possible to have a better distribution of the tensile forces on the glove due to the two anchoring points 6A*a*, 6B*b* constituted by the double upper fixed point.

According to a third embodiment shown in FIG. 3, the upper fixed point 6B is constituted by a single eyelet 11B fixed on the outer envelope of the glove, through which the strap 3B passes.

This strap 3B is provided at its upper end with gripping means V1, of the Velcro type, for example, which are complementary of complementary gripping means V2 arranged on the outer envelope of the glove. In such an embodiment, the traction of the strap 3B occurs with respect to the glove 1B itself. Moreover, the path S of the strap 3B is identical to the previously described paths.

The present invention is not limited to the embodiments described but encompasses all similar or equivalent modes of construction.

Thus, each of the tightening straps described in each of the embodiments can be partially or entirely elastic or non-elastic.

It is noted that the spiral path S described by the tightening strap(s) is particularly interesting and enables an efficient tightening adapted to the hand morphology while limiting, as much as possible, the risks of discomfort with respect to blood circulation.

What is claimed is:

1. A glove adapted to the practice of a sport, said glove comprising:

a covering of a hand of a user and a tightening arrangement, said arrangement comprising a strap extending from a lower fixed point of said hand covering, said lower fixed point being located in an area of a wrist of the user, and extending freely around the hand covering toward an upper fixed point located substantially perpendicular to said lower fixed point by describing a spiral, said upper fixed point constituting a traction hold relative to which said strap is adapted to be biased to tighten the glove around the user's hand, along a path that corresponds to one turn but does not close on itself.

2. A glove according to claim 1, wherein said spiral described by said tightening strap makes a complete turn around said glove.

3. A glove according to claim 1, wherein said lower point is located in a lateral zone of the wrist, extends around the lateral zone of the wrist on an inner surface, on a side of the palm of the glove, and extends toward said upper fixed point located on the back of the glove, along a spiral.

4. A glove according to claim 3, wherein said upper point, located on the back of the glove, is positioned substantially in an intersection zone of the forefinger and of the thumb.

5. A glove according to claim 1, wherein said lower fixed point is constituted by a seam affixing one end of the strap to the glove in a lateral zone of the wrist.

6. A glove according to claim 1, wherein said upper fixed point is constituted by a buckle in which a second free end of said strap is introduced before being folded back so as to be immobilized in position, according to a desired tension, via a fixing arrangement.

7. A glove according to claim 6, wherein said fixing arrangement comprises a self-gripping mechanism that is arranged complementarily on two surfaces of the end of said strap, facing one another once they have been folded back, or on one surface of the end of said strap and the outer envelope of the glove.

8. A glove according to claim 1, wherein said strap is guided at least partially by a sheath, obtained by doubling the constituent material of the glove, in which said strap slides freely.

9. A glove according to claim 1, wherein the tightening of the glove on the user's hand is done by an elastic strap, connecting said lower fixed point to said upper fixed point by means of a buckle constituting the traction hold and which is affixed to the back of the glove.

10. A glove according to claim 1, wherein the tightening of the glove on the user's hand is done by a non-elastic strap, connecting said lower fixed point to said upper fixed point by means of a buckle constituting the traction hold, which is itself affixed to the free end of an elastic element, the other free end of which is connected by a seam on the back of the glove to constitute said upper fixed point.

11. A glove according to claim 1, wherein the tightening of the glove on the user's hand is done by a strap connecting said lower fixed point to said upper fixed point by means of the buckle constituting the traction hold, which is itself affixed to the end of an element, the other free end of which is connected by a seam to an equally free end of a fork-shaped flexible piece, each of the arms of which is connected by seams to the glove, in the zone of the forefinger and in the zone of the thumb, respectively, constituting a double upper fixed point.

* * * * *